US006167580B1

(12) United States Patent
Draheim et al.

(10) Patent No.: US 6,167,580 B1
(45) Date of Patent: Jan. 2, 2001

(54) CRIB DROPSIDE ASSEMBLY AND METHOD OF INSTALLATION

(75) Inventors: Harvey J. Draheim, Weyauwega; Scott A. Krueger, Appleton; Gaetan Philippon, New London, all of WI (US)

(73) Assignee: Simmons Juvenile Products Company, Inc., New London, WI (US)

( * ) Notice: Under 35 U.S.C. 154(b), the term of this patent shall be extended for 0 days.

(21) Appl. No.: 09/318,016

(22) Filed: May 25, 1999

(51) Int. Cl.[7] ..... A47D 7/02
(52) U.S. Cl. ..... 5/100; 5/93.1
(58) Field of Search ..... 5/93.1, 99.1, 100, 5/424, 428, 430

(56) References Cited

U.S. PATENT DOCUMENTS 797,852 * 8/1905 Hayden ..... 5/100 X
1,465,414 * 8/1923 Boardman ..... 5/100 X
1,695,571 * 12/1928 Baxter ..... 5/100
2,289,132 * 7/1942 Lehman, Jr. et al. ..... 5/100
2,329,475 * 9/1943 Lehman, Jr. et al. ..... 5/100 X
2,369,834 * 2/1945 Lundin ..... 5/100
5,165,124 * 11/1992 Li ..... 5/100
5,617,593 * 4/1997 Pham ..... 5/100

* cited by examiner

*Primary Examiner*—Terry Lee Melius
*Assistant Examiner*—Robert G. Santos
(74) *Attorney, Agent, or Firm*—Hoffmann & Baron, LLP

(57) ABSTRACT

A crib is provided which includes a dropside mounted to endboards of the crib. The dropside is secured to opposing pairs of tracks. Each lower track includes a pair of generally parallel grooves, one of which extends substantially below the other. The dropside is coupled to the lower tracks by a pair of spring bracket assemblies, each of which includes a laterally extending spring arm. The spring arm includes a continuously curved upper surface. In order to prevent the inadvertent displacement of the dropside, the relatively short groove includes a portion of reduced width. Each spring bracket assembly includes a longitudinally extending pin which may be moved easily through each groove except the groove portion of reduced width. Assembly of the crib is facilitated by coupling one of the spring bracket assemblies to the dropside as the final step of mounting the dropside to the crib.

23 Claims, 22 Drawing Sheets

CRIB DROPSIDE ASSEMBLY AND METHOD OF INSTALLATION

BACKGROUND OF THE INVENTION

1. Field of the Invention

The field of the invention relates to cribs and crib dropside assemblies, to certain components of such cribs and assemblies, and to methods of installing crib dropsides onto cribs.

2. Brief Description of the Related Art

Crib dropsides are employed for facilitating access to infants or small children confined by the sides and ends of a crib. A typical crib includes two opposing end boards and two opposing sides. At least one of the sides is movable between raised and lowered positions, and is referred to as the dropside. The end boards of the crib may be connected by stabilizing bars. A mattress support, which is also referred to as a spring deck, is conventionally secured to the corner posts of the crib.

Many types of dropside assemblies have been developed for use with cribs. A common objective of most, if not all dropsides is to prevent actuation thereof by children or infants. Adults, however, should be able to raise or lower the dropside without difficulty.

One type of dropside assembly which has been available for a number of years includes two opposing pin guides each having an inverted, generally J-shaped groove. The guides are mounted to opposing corner posts. A pin extends from each end of he lower portion of the dropside and within one of the grooves. The pins are positioned at the bottoms of the shorter legs of the inverted J-shaped grooves when the dropside is in the raised position. Conversely, the pins are positioned at the bottoms of the longer legs of the grooves when the dropside is in the lowered position. Dropside assemblies of this type may be difficult to assemble as the pins extending from each end of the dropside must be positioned within opposing grooves.

SUMMARY OF THE INVENTION

The present invention is directed to a height adjustment assembly for a crib dropside, a crib dropside assembly, a method of assembling a dropside to a crib, and to a crib having a dropside which is easy to assemble and reliable in operation.

A height adjustment assembly for a crib dropside is provided which includes first and second tracks, each of the tracks including a first groove having a bottom end, a second groove having a bottom end, each of the first and second grooves having a substantially vertical portion, the bottom end of the second groove being substantially below the bottom end of the first groove. A connecting groove portion extends between the first and second grooves, preferably at the top ends thereof First and second spring bracket assemblies are provided for engagement with the tracks. Each spring bracket assembly includes a body portion and a pin extending longitudinally from the body portion and positionable in the grooves within the first and second tracks. A spring arm is pivotably mounted to the body portion and extends laterally therefrom. The spring arm includes a substantially continuously curved upper surface. In a preferred embodiment of the invention, each of the tracks includes a wall extending substantially perpendicularly from the base portions of the tracks and proximate the second groove. The spring arms are engageable with the walls to urge the pin in the direction of the first groove. A crib dropside including such a spring bracket assembly is further provided in accordance with the invention.

A crib dropside assembly is provided in accordance with the invention. This assembly includes first and second upper tracks mounted, respectively, to first and second corner posts. First and second lower tracks are also mounted to the first and second corner posts. The dropside is slidably coupled to the lower tracks and upper tracks. Pins mounted to the dropside are employed for coupling the dropside to the lower tracks. Each of the lower tracks includes a first groove having a bottom end, a second groove having a bottom end, the bottom end of the second groove being substantially below the bottom end of the first groove. Each of the first and second grooves has a substantially vertical portion. A connecting portion connects the first and second grooves. Each of the first grooves includes a transition portion of reduced width between its bottom end and the connection portion. Each of the pins mounted to the dropside has a diameter which approximates the width of the transition portion. The transition portion accordingly provides resistance to movement of the pins between the bottom ends of the first grooves and the connecting portions. A lower track as described above forms another aspect of the invention.

A method of assembling a dropside to a crib is further provided. The crib includes first and second corner posts, first and second upper tracks and first and second lower tracks mounted, respectively, to the corner posts, each of the first and second lower tracks including grooves therein for receiving a pin, and each of the grooves including a lower end and an upper end. The method includes the steps of providing a dropside including a top rail, a bottom rail, and first and second connecting members mounted to opposite ends of the top rail, providing first and second bracket assemblies, each bracket assembly including a body portion and a pin extending longitudinally from the body portion, mounting the first bracket assembly to the bottom rail of the dropside, coupling the first and second connecting members to the first and second upper tracks, inserting the pin of the first bracket assembly into the groove of the first lower track, inserting the pin of the second bracket assembly into the groove in the second lower track, and mounting the second bracket assembly to the bottom rail of the dropside while the pin of the second bracket assembly remains in the second lower track.

Finally, a novel mattress support including pivotable hangers is provided by the invention. The hangers include tabs for engaging a support frame of the mattress support.

DETAILED DESCRIPTION OF THE INVENTION

Figure 1:
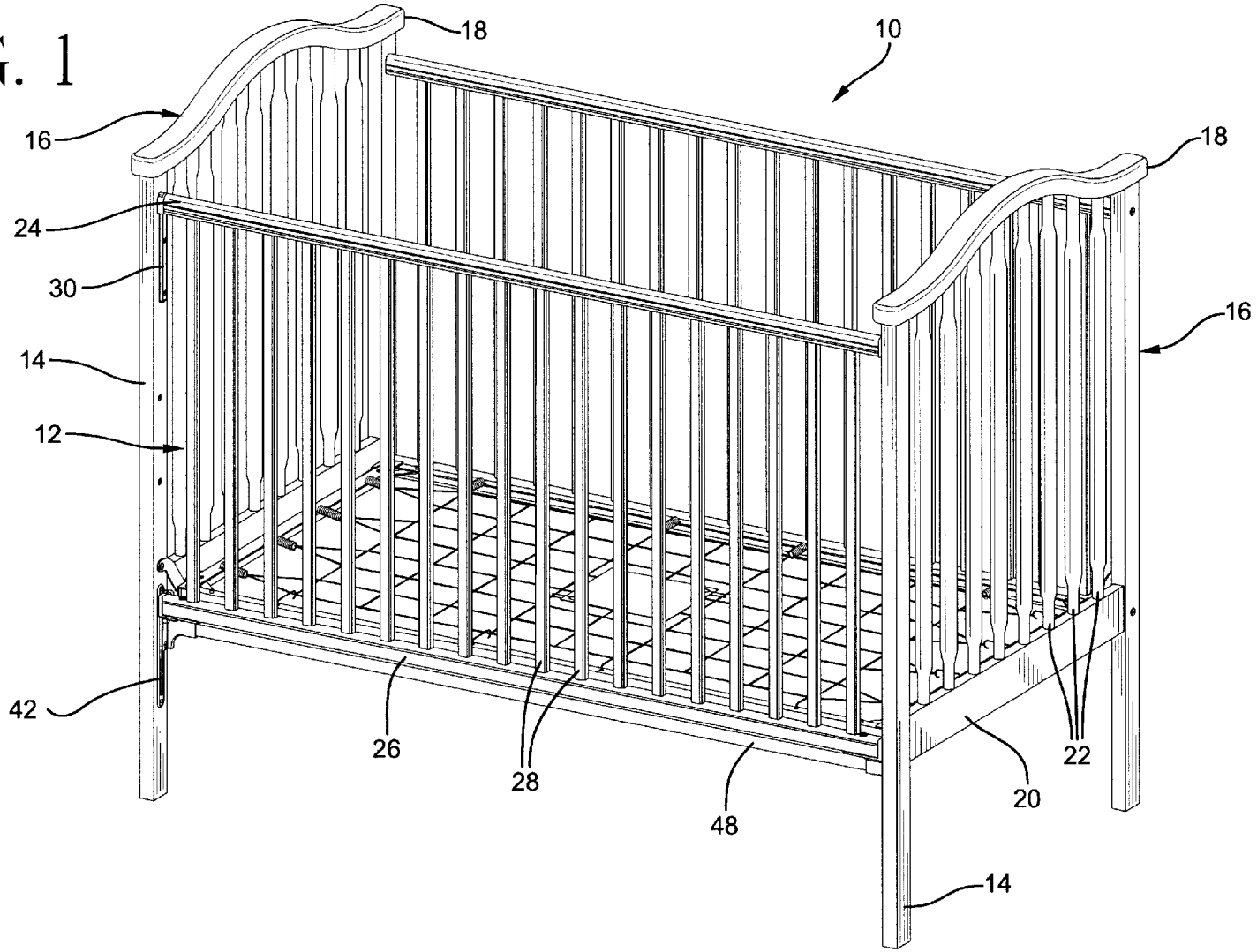
FIG. 1 is a top perspective view of a crib according to the invention.

A crib 10 is provided which includes a dropside 12 slidably mounted to a pair of opposing corner posts 14 of the crib, as shown in FIG. 1. While the corner posts 14 shown in FIG. 1 are discrete members of the opposing crib endboards 16, they may instead be integral portions of the endboards. The endboards shown in the drawing also include top rails 18, bottom rails 20 and stretchers 22 connecting the top and bottom rails. The dropside 12 includes a top rail 24, a bottom rail 26 and connecting slats 28. The types of stretchers used in the dropside and endboard between the top and bottom rails are unimportant with respect to the inventions described herein. Some endboards include no stretchers at all.

Figure 3:
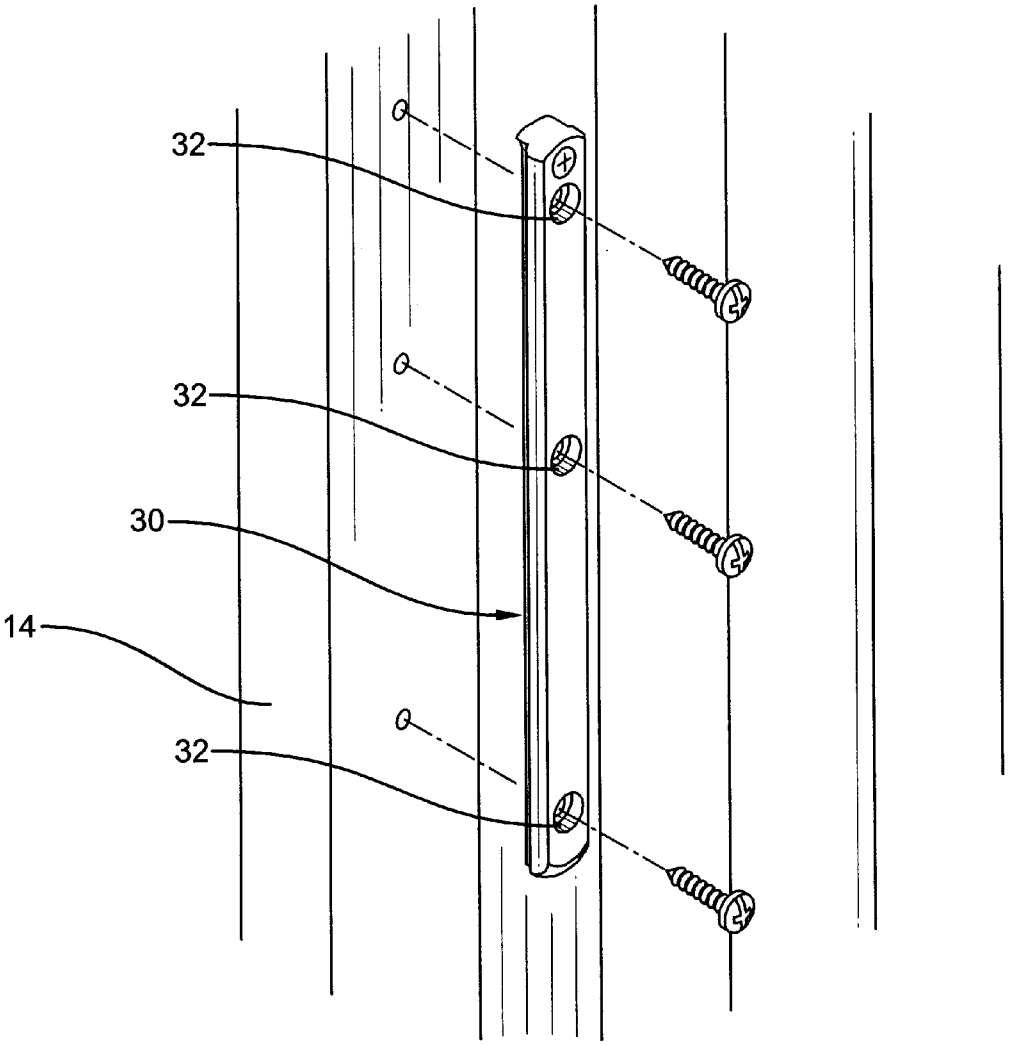
FIG. 3 is a partially exploded, top perspective view of the top portion of the crib endboard.

First and second upper tracks 30 are mounted to the upper portions of two opposing corner posts 14, as shown in FIG. 3. These tracks include openings 32 which allow them to be secured to the corner posts by screws. Each upper track is generally T-shaped in cross section. The tracks. are mounted such that the relatively wide faces thereof are in opposing relation. The upper tracks are preferably made from a plastic material such as acetal resin. The ends of each track are rounded. The upper ends of the base portions of the upper tracks are enlarged to form stops 34, as best shown in FIG. 21.

Figure 10:
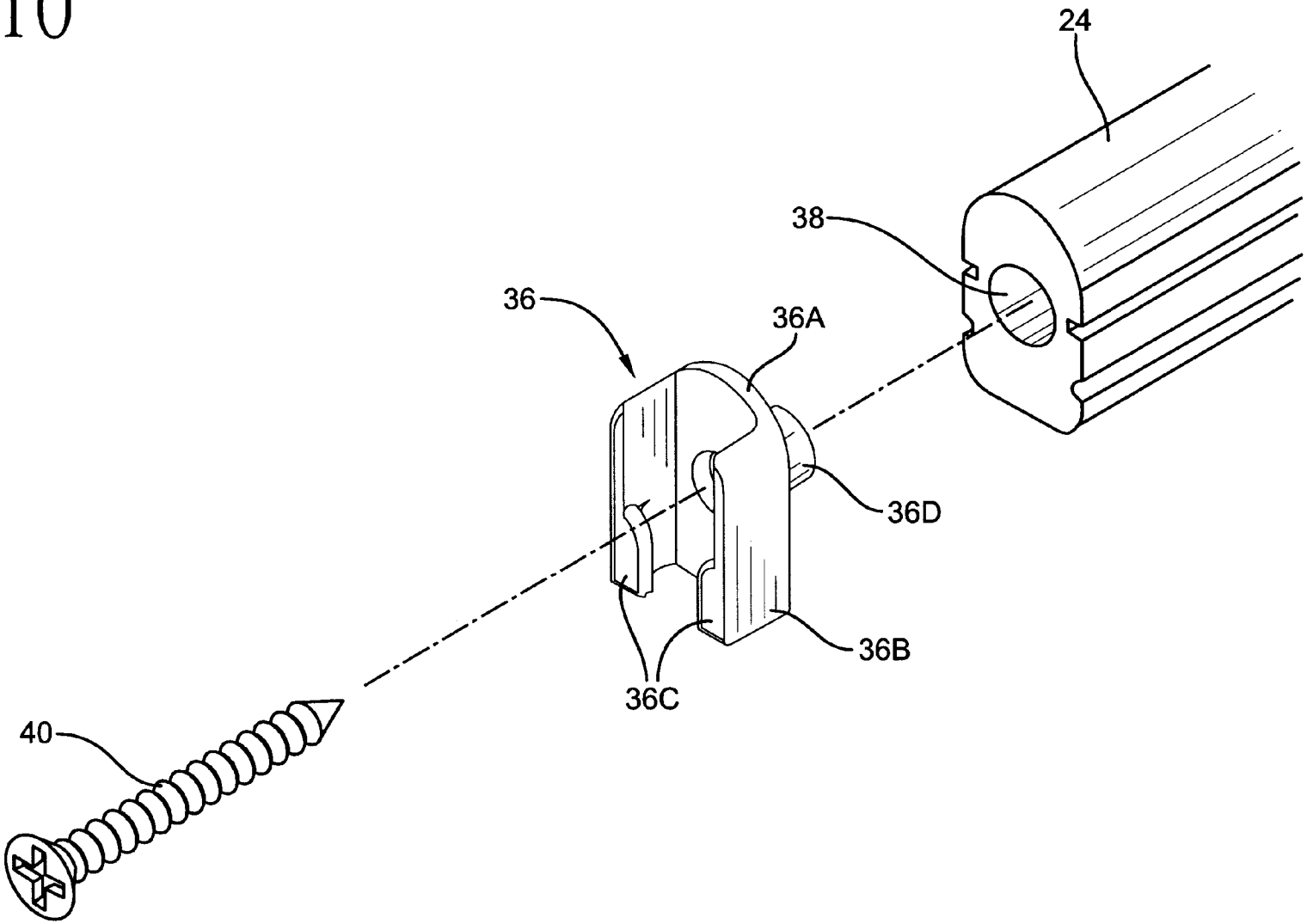
FIG. 10 is an exploded, perspective view of the top rail of the dropside and a connecting member.
Figure 20:
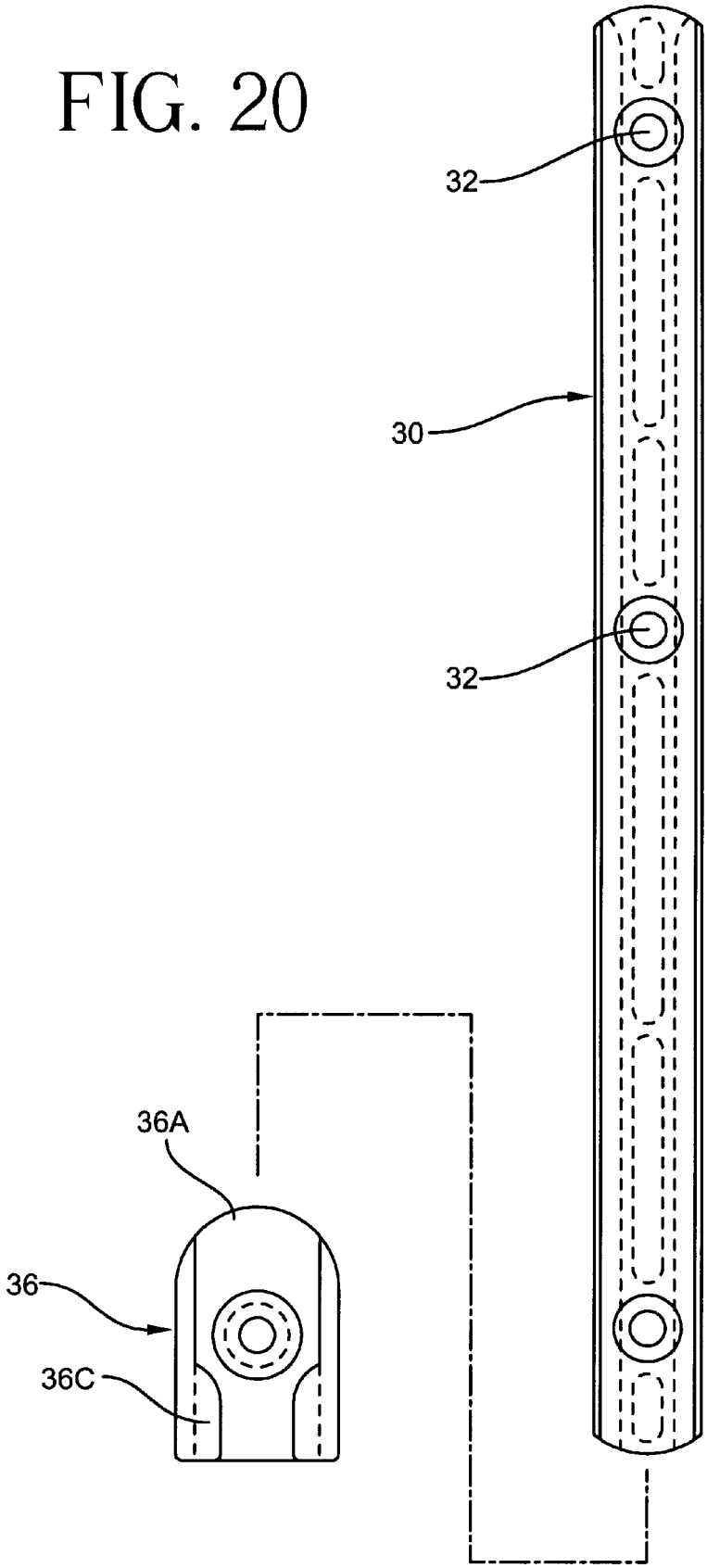
FIG. 20 is a front elevation view of an upper track and a connecting member therefor.
Figure 21:
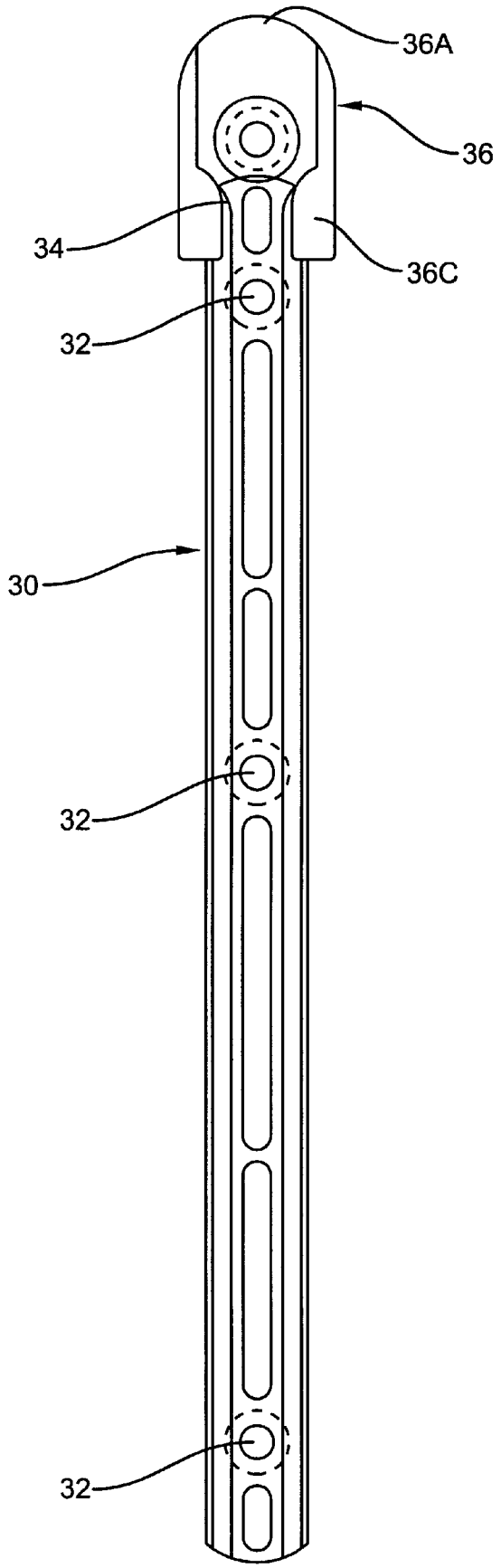
FIG. 21 is a rear elevation view of the connecting member coupled to the upper track.

The dropside is slidably coupled to the upper tracks by first and second connecting members 36, as shown in FIGS. 20 and 21. Each connecting member includes an end wall 36A having a rounded top surface and a flat bottom surface. A pair of opposing side walls 36B are integral with the end wall, and taper inwardly at their upper ends where they adjoin the rounded top surface of the end wall. The curvature at the top portion of the connecting members is substantially the same as that of the rounded ends of the upper tracks 30. A pair of flanges 36C extend inwardly from the side walls. In the preferred embodiment disclosed herein, the height of the flanges is less than half the height of the side walls. The distance between the inner surfaces of the side walls exceeds the maximum width of the upper tracks 30. The distance between the inner surfaces of the flanges is greater than the width of the base portions of the upper tracks. When coupled to the upper tracks, there is considerable play between the connecting members and the tracks. This facilitates operation and assembly of the dropside. As the distance between flanges is less than the maximum width of the upper tracks, the connecting members provide reliable coupling of the dropside to the corner posts of the crib. The stop 34 is engageable by the upper ends of the flanges 36C, thereby limiting the upward travel of the dropside while preventing disengagement of the upper tracks 30 and connecting members 36. A cylindrical projection 36D extends from the end wall 36A of each connecting member. This projection is insertable in a bore 38 within either end of the top rail 24 of the dropside, as shown in FIG. 10. Screws 40 are employed to mount the connecting members to the dropside. The inner surfaces of the end walls 36A are counterbored so that the screws do not interfere with the ability of the connecting members to slide freely along the upper tracks.

Figure 2:
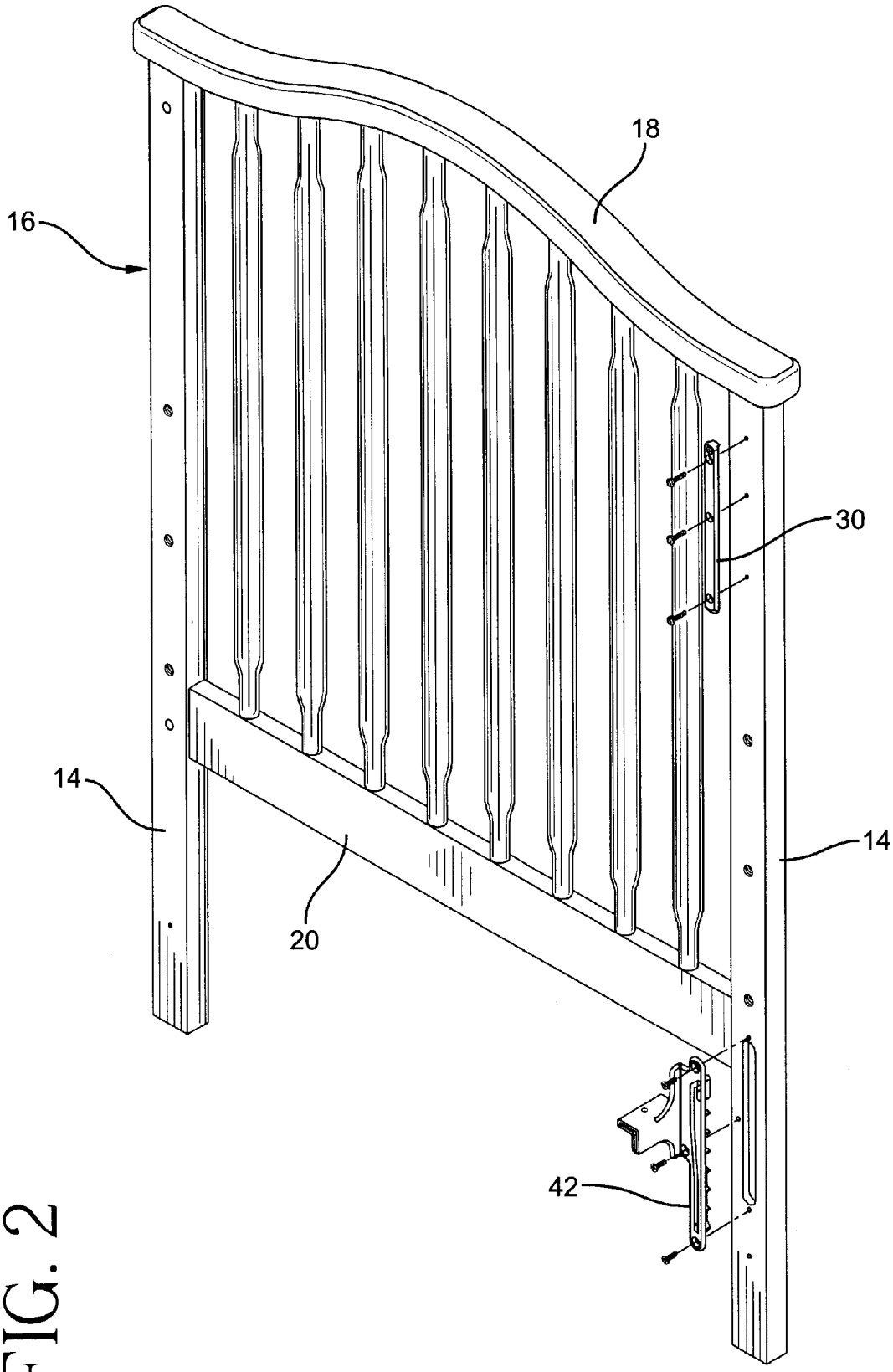
FIG. 2 is a partially exploded, top perspective view of a crib endboard according to the invention.
Figure 4:
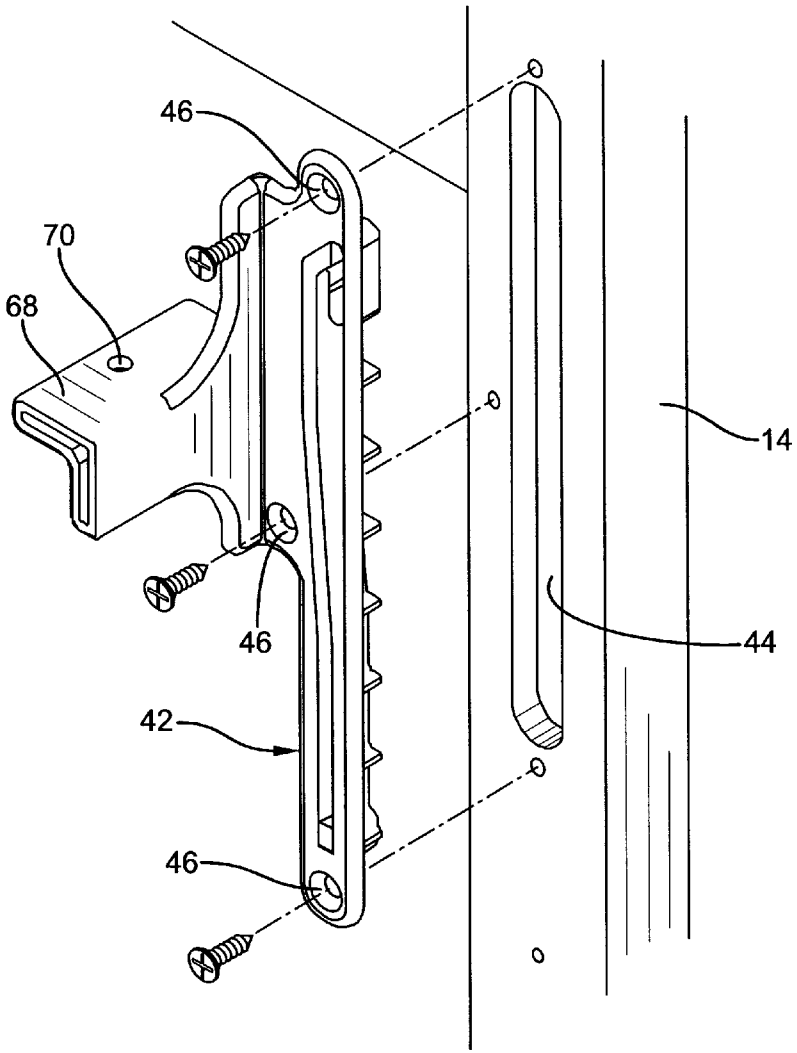
FIG. 4 is a partially exploded, top perspective view of a lower portion of the crib endboard.
Figure 5:
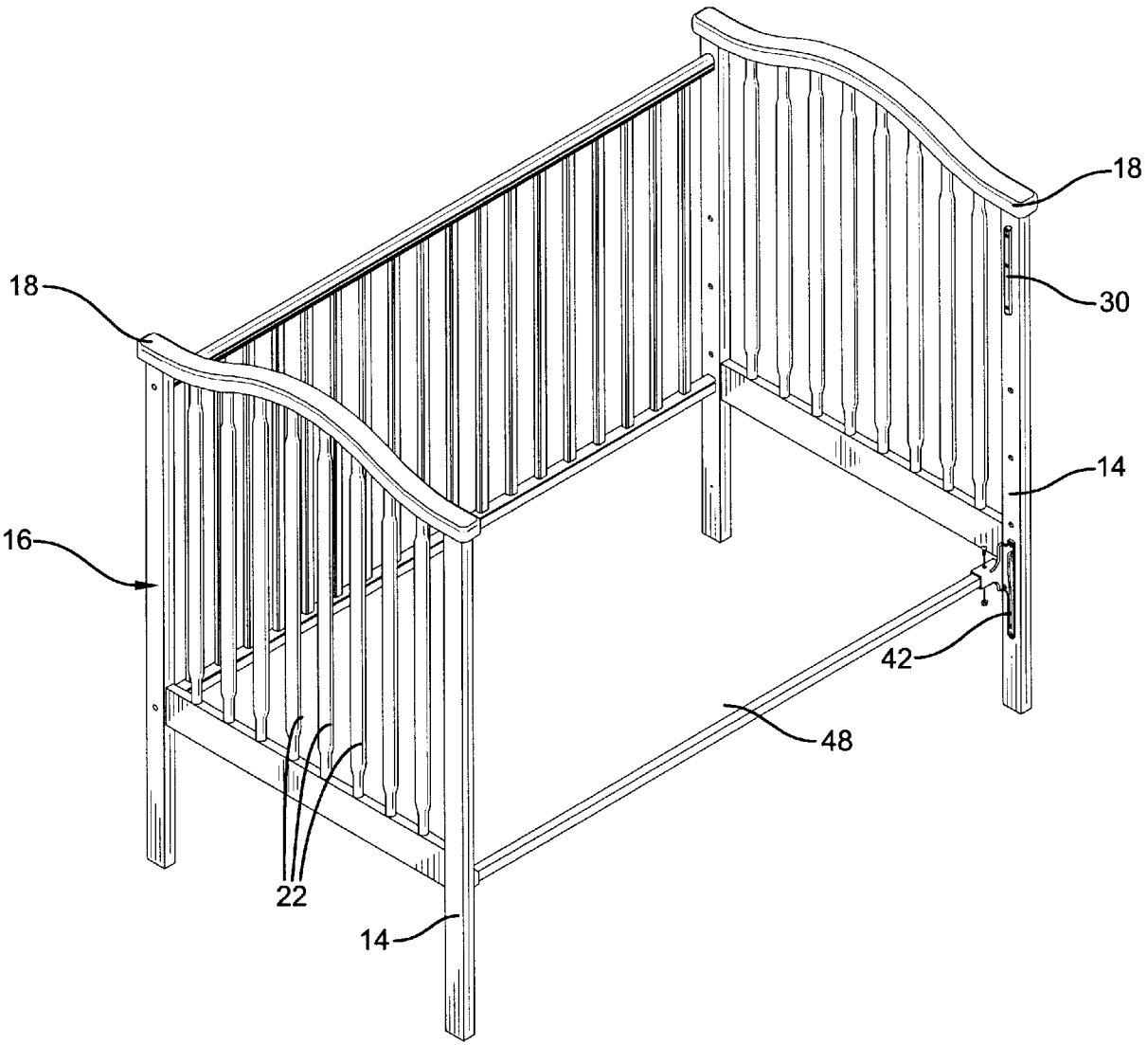
FIG. 5 is a top perspective view of the crib without a mattress support or dropside.

First and second lower tracks 42 are mounted to the corner posts by a plurality of screws, as shown in FIGS. 2 and 4. Each corner post includes an elongate channel 44 therein for receiving protruding rear portions of the tracks. This both facilitates assembly by the user and provides stability. Once positioned in a channel, three counterbored openings 46 in the track are aligned with three bores in the corner post, allowing the consumer to quickly and easily mount the tracks. Such mounting is preferably accomplished after the stabilizing bar 48 is first coupled to the upper tracks, as described below.

Figure 18:
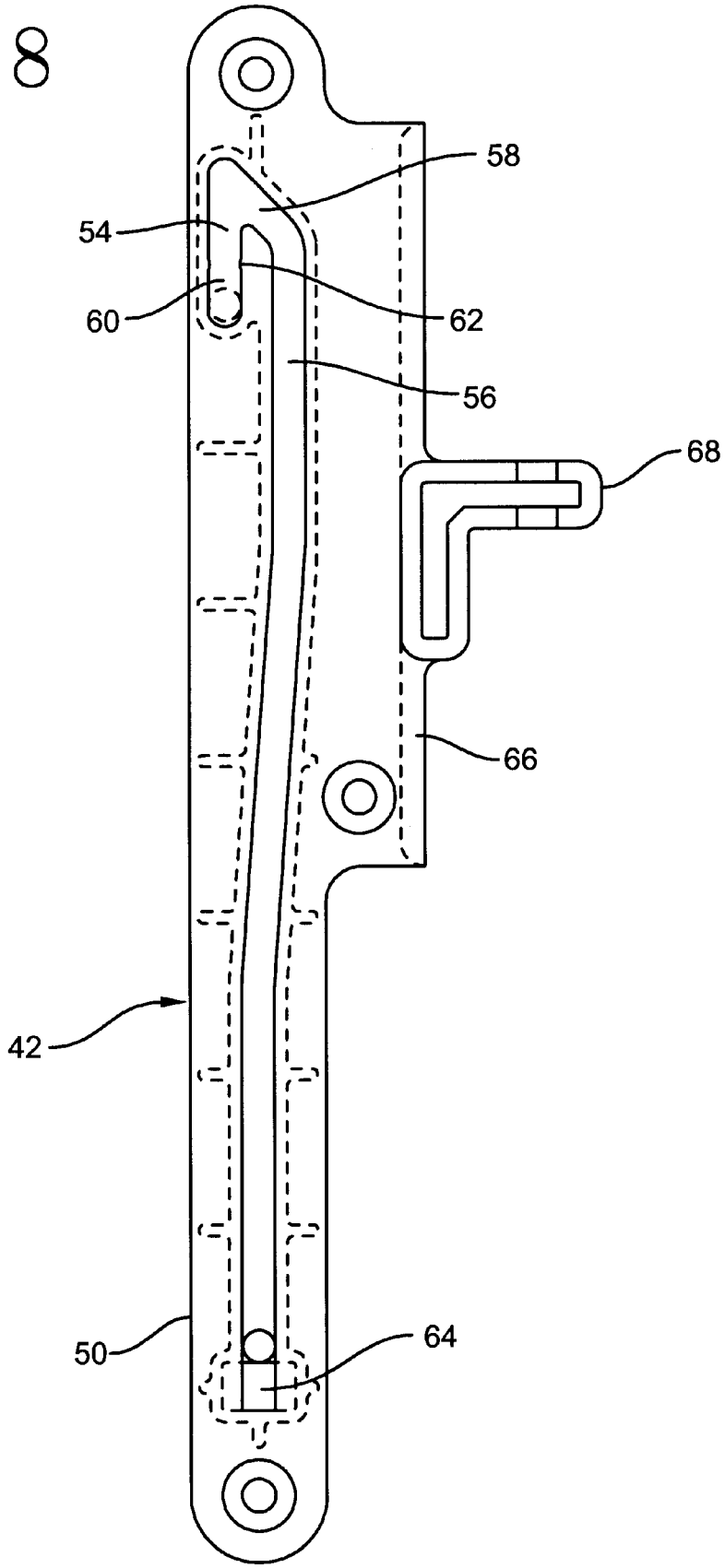
FIG. 18 is a front elevation view of a lower track according to the invention.
Figure 19:
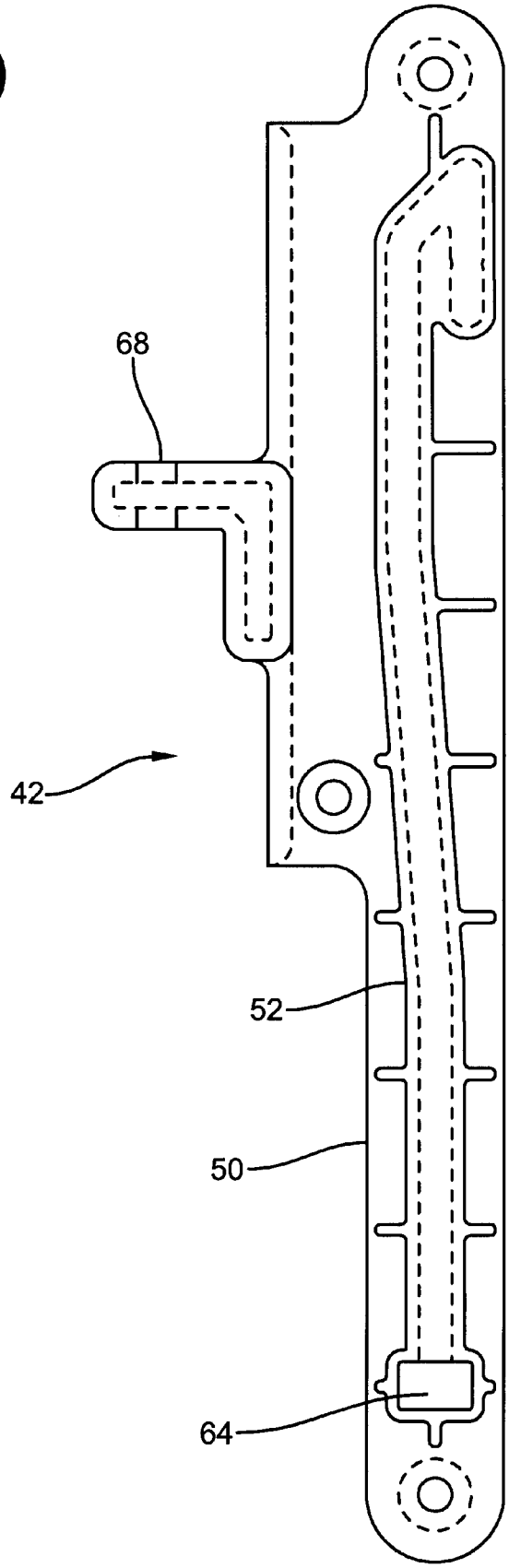
FIG. 19 is a rear elevation view thereof.

Each lower track 42 is preferably integrally formed from a plastic material such as acetal resin, which provides strength without brittleness. The track includes an elongate base 50 having a protruding elongate rear portion 52 (FIG. 19) that fits snugly into one of the elongate channels 44 in a corner post. A first groove 54 is defined near the upper end of the track. A second groove 56 extends along most of the length of the track, as shown in FIG. 18. The second groove is substantially longer than the first groove, and has a bottom end located substantially below the bottom end of the first groove. A connecting groove portion 58 connects the first and second grooves, preferably at the upper ends thereof. The upper wall of the connecting groove portion is angled upwardly towards the upper end of the first groove. Each of the first and second grooves is substantially uniform in width. The first groove, however, includes a transition portion 60 of reduced width between the bottom end thereof and the connecting groove portion. This portion is preferably, but not necessarily formed by a pair of opposing, rounded projections 62 extending from the opposing walls of the groove. A resilient stop member 64 is mounted to the track at the bottom end of the second groove.

Figure 6:
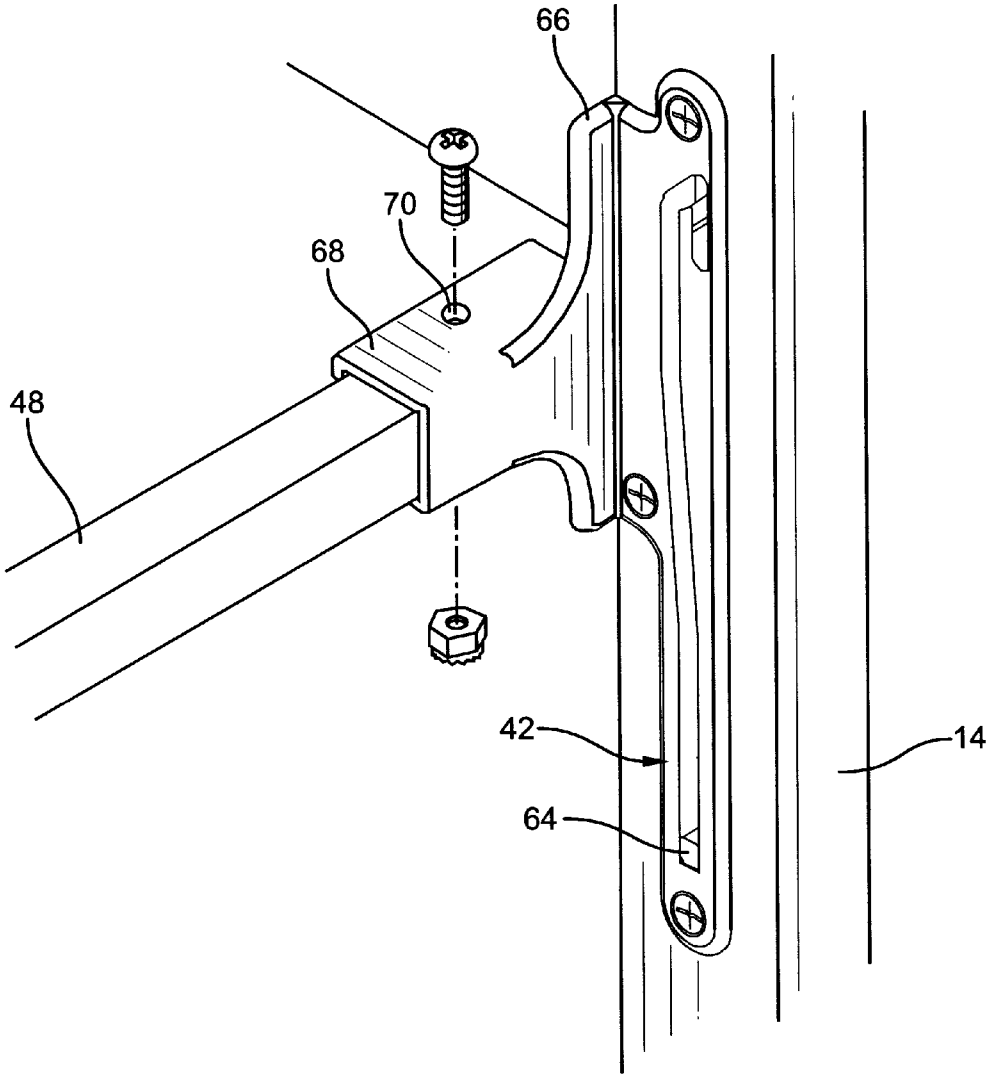
FIG. 6 is a partially exploded top perspective view showing a stabilizing bar coupled to a lower track.

In accordance with the preferred embodiment of the invention, the lower tracks also function as stabilizing bar brackets. Each lower track includes a wall 66 extending substantially perpendicularly to the base 50 and substantially parallel to the upper ends of the first and second grooves 54, 56. A bracket 68 defining an L-shaped channel is integral with the wall 66. A bore 70 extends through the bracket to allow securement of the stabilizing bar 48. Each end of the stabilizing bar 48 includes an opening (not shown) which can be aligned with the bore 70. A bolt is inserted through the bore and opening, and secured by a locking nut, as shown in FIG. 6. It will be appreciated that the wall 66 and/or bracket 68 may be provided as separate elements which are not coupled to the track. The embodiment as shown and described is preferred both for ease of assembly and reliability in operation.

Figure 12:
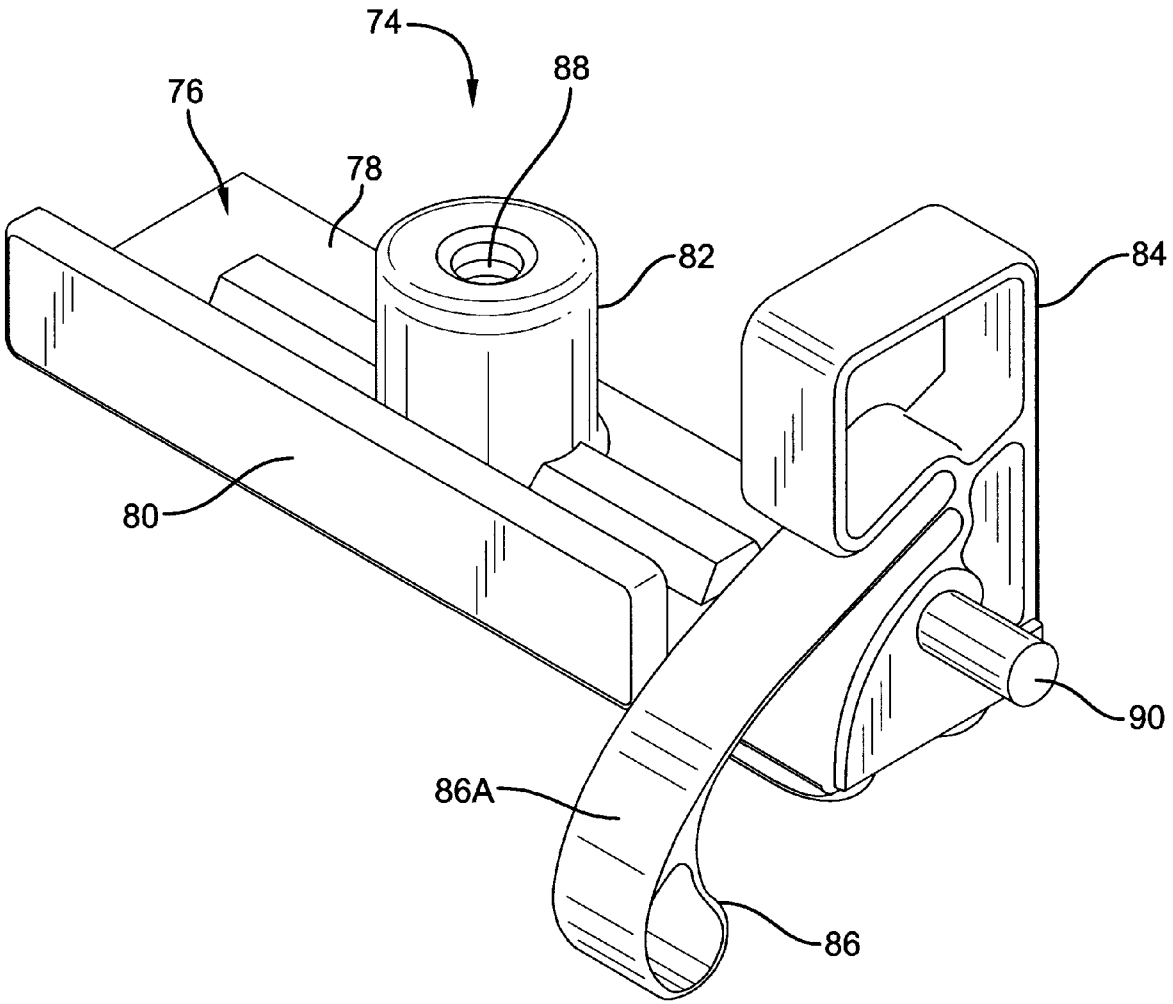
FIG. 12 is a top perspective view of a spring bracket assembly according to the invention.

The dropside is coupled to the lower tracks 42 by a pair of spring bracket assemblies 74. Each such assembly includes an elongate body portion 76 including a base portion 78, a side wall 80, a cylindrical projection 82 extending from the base portion, and an end wall 84. A spring arm 86 is integral with the end wall 84, and extends laterally therefrom. The upper surface of the spring arm includes a continuously curved portion 86A. The spring arm is capable of pivotal movement with respect to the body portion 76. The body portion and spring arm are preferably made from a strong, durable plastic material such as acetal resin. The configuration of the body portion, though preferred, is not considered critical to the successful operation of the invention described herein. FIG. 12 shows one of the spring bracket assemblies provided in accordance with the invention.

Figure 11:
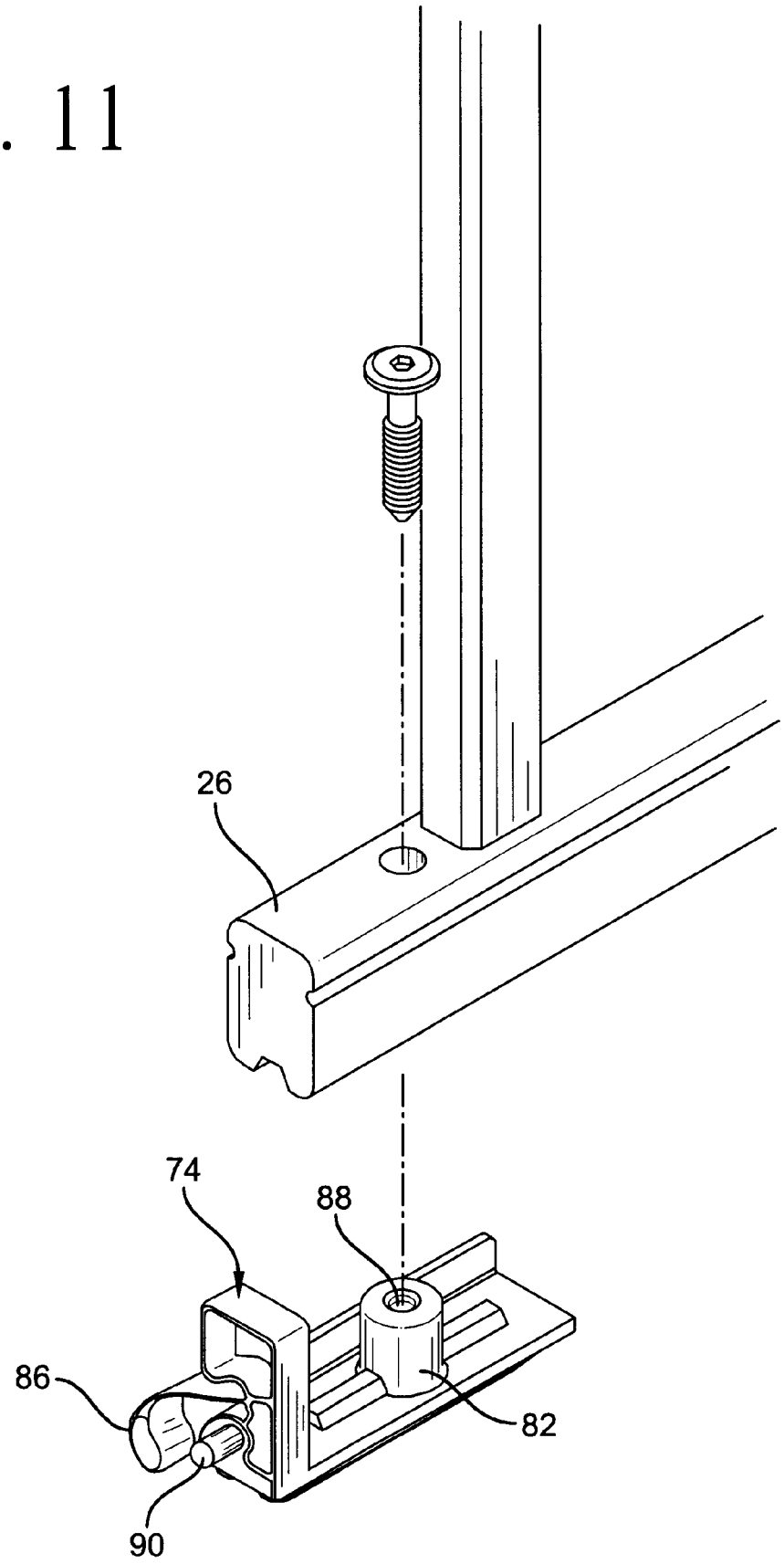
FIG. 11 is an exploded, perspective view of a bottom portion of the dropside, including a spring bracket assembly.

A threaded steel insert 88 is provided within the cylindrical projection 82. This allows the spring bracket assembly to be coupled to the bottom rail of the dropside, as shown in FIG. 11. A stainless steel pin 90 is securely fastened to the end wall 84 of the spring bracket assembly below the point at which the spring arm is coupled thereto. Such fastening may be achieved by providing an annular groove (not shown) in the pin, and injection molding the body portion 76 of the spring bracket assembly about the pin.

The diameter of the pin 90 is slightly less than the width of the first and second grooves 54, 56 of the lower tracks 42. It is, however, about the same in diameter as the width of the transition portion 60, or slightly larger. Accordingly, the transition portion provides resistance to the pin being displaced once positioned at the bottom of the first groove 54.

Figure 7:
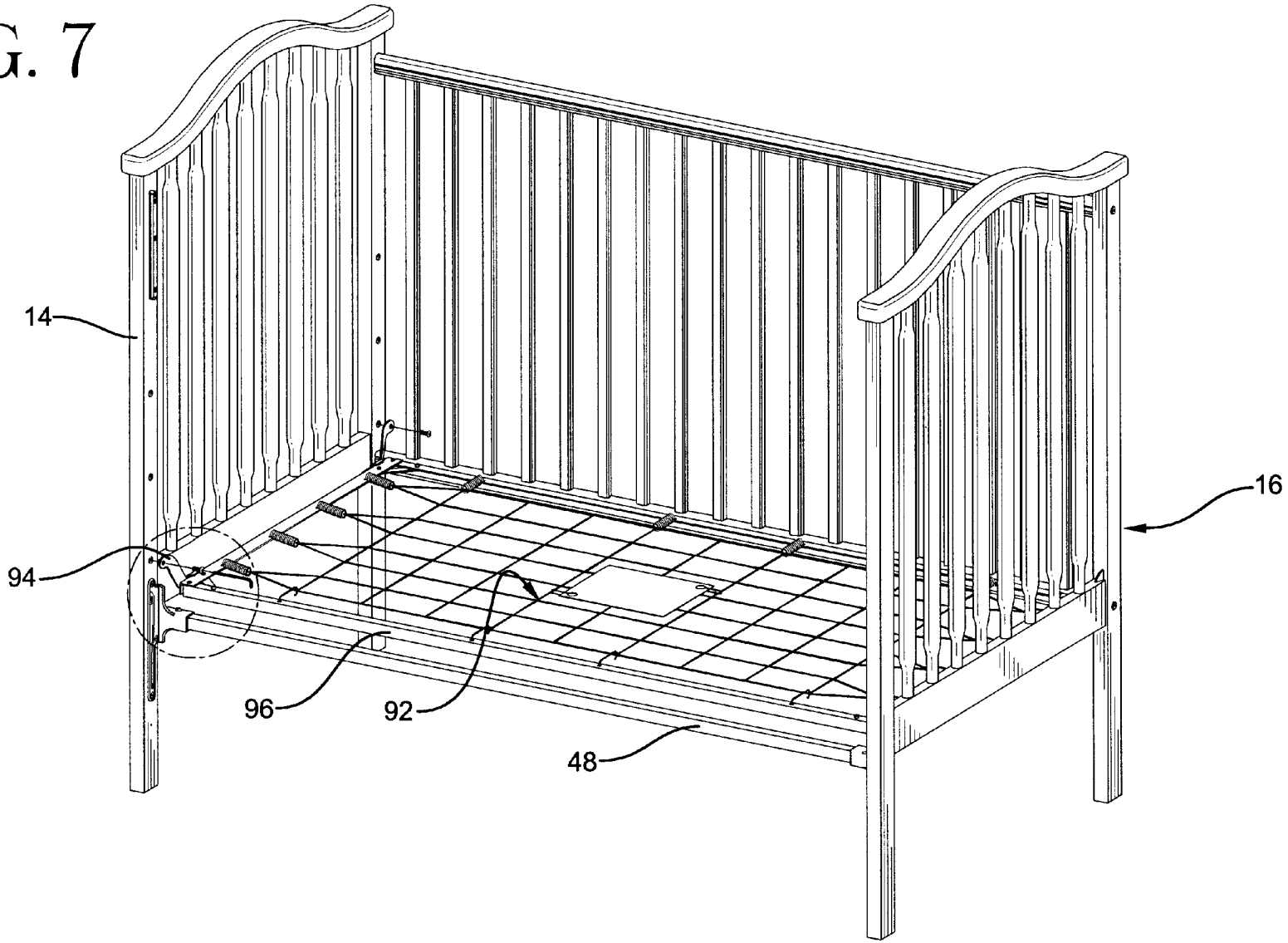
FIG. 7 is a top perspective view of the crib without a dropside.
Figure 8A:
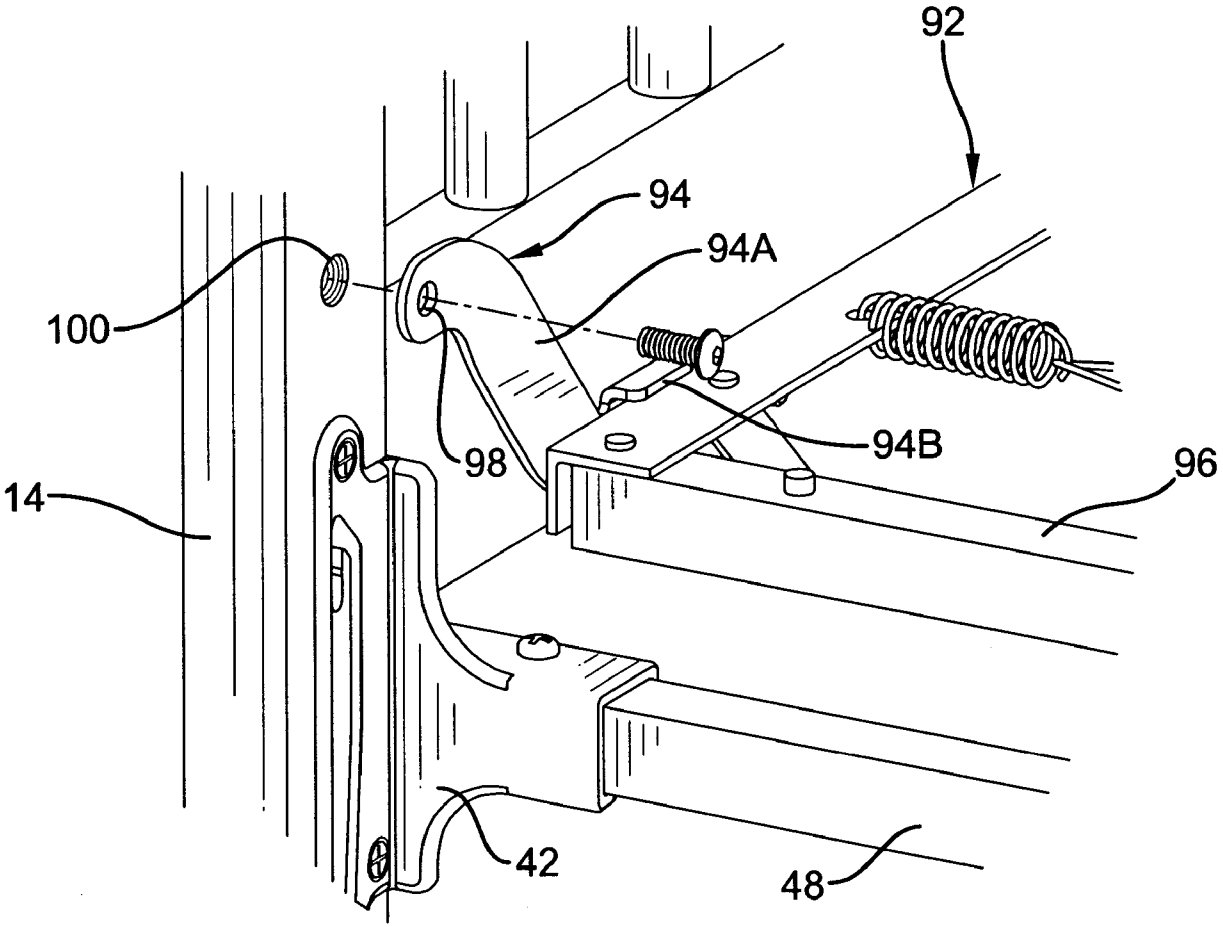
FIG. 8A is a top perspective view showing the connection of a mattress support in accordance with the invention to an endboard of the crib.
Figure 8B:
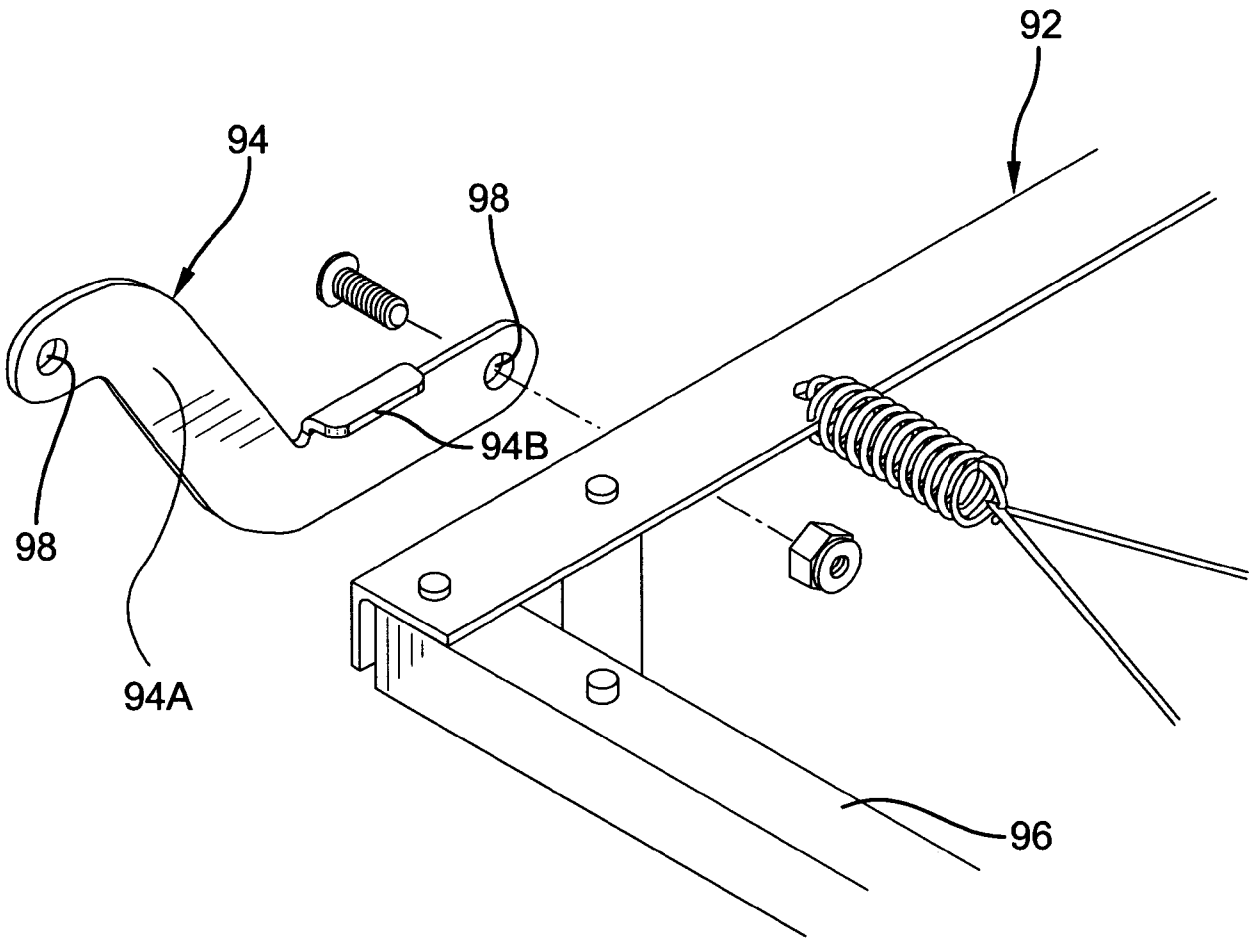
FIG. 8B is an exploded, perspective view of a hanger and a portion of the associated mattress support.

Referring to FIG. 7, a mattress support 92 is mounted to the corner posts 14 of the crib by four hangers 94 which are pivotably coupled to a support frame 96. Each hanger 94 includes a generally S-shaped, planar body 94A having an integral, laterally extending tab 94B, as shown in FIGS. 8A and 8B. An opening 98 at each end of the hanger allows it to be coupled to the support frame 96 and corner posts 14, respectively. The tab 94B is positioned to engage the upper surface of the support frame as shown in FIG. 8A, thereby limiting the extent to which the hanger can rotate with respect thereto. The mattress support can preferably be secured at a plurality of heights on the crib. Threaded openings 100 are provided in the corner posts to allow the user to select the appropriate mattress support position.

The assembly of the crib shall now be described. The endboards 16 are coupled to the stationary side of the crib by threaded bolts or the like. Holes in these components are provided by the manufacturer to facilitate the assembly of these and other components by the consumer.

Before mounting the lower tracks 42 to the corner posts 14 opposite to the stationary side of the crib, the stabilizing bar 48 is secured to each lower track by inserting the ends of the bar into each bracket 68. The openings in the bar 48 are aligned with the bores 70 in the brackets, and the appropriate bolts are inserted therethrough. The bolts are maintained by lock nuts applied thereto.

The stabilizing bar/track assembly is positioned such that the openings 46 in the track are aligned with corresponding bores in the corner posts and the rear portions 52 of the tracks are positioned within the elongate channels 44. The tracks are then secured to the corner posts by screws extending through the openings 46 and into the bores.

The mattress support 92 and hangers 94 are assembled by bolts and lock nuts. This assembly is then mounted to the corner posts by threaded bolts extending through the hanger openings 98 and into the appropriate bores, as shown in FIGS. 7 and 8.

Figure 9:
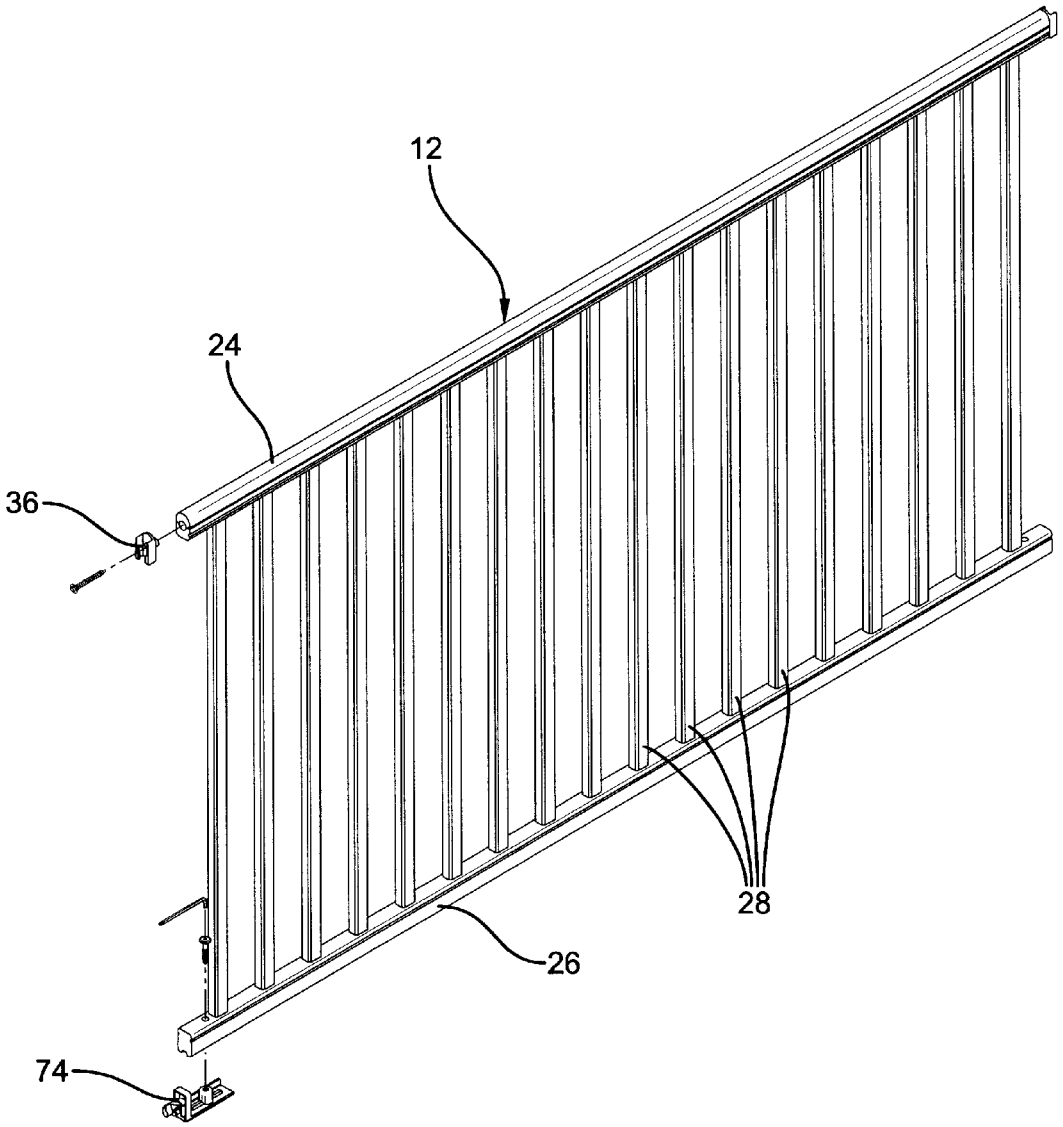
FIG. 9 is a partially exploded, top perspective view of a crib dropside according to the invention.
Figure 13:
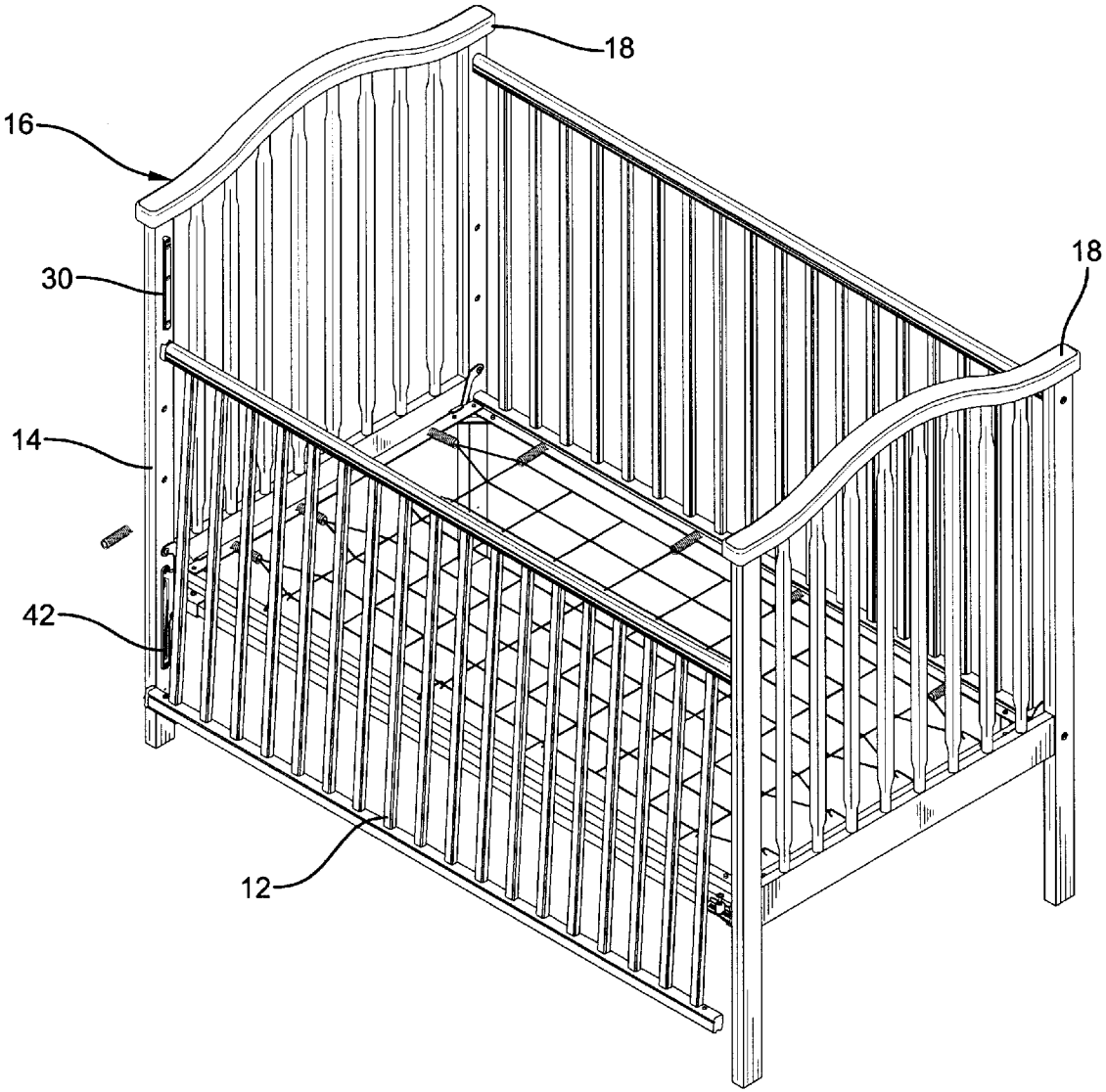
FIG. 13 is a top perspective view showing the step of mounting the dropside to the crib.
Figure 14:
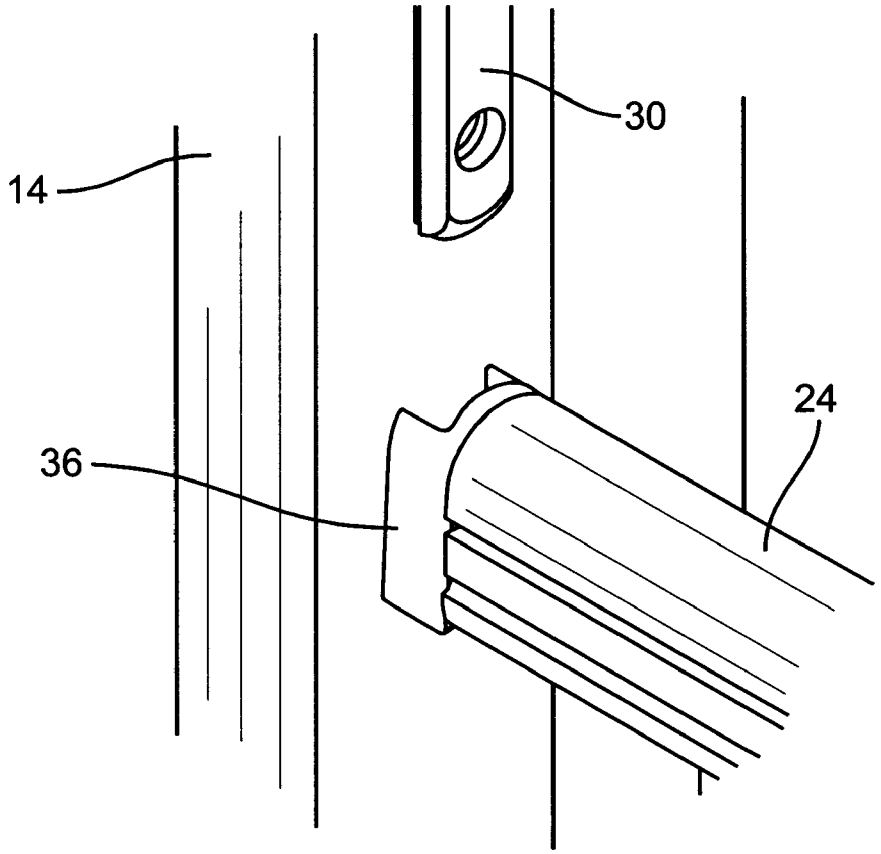
FIG. 14 is a perspective view showing the step of coupling the dropside to an upper track.
Figure 15:
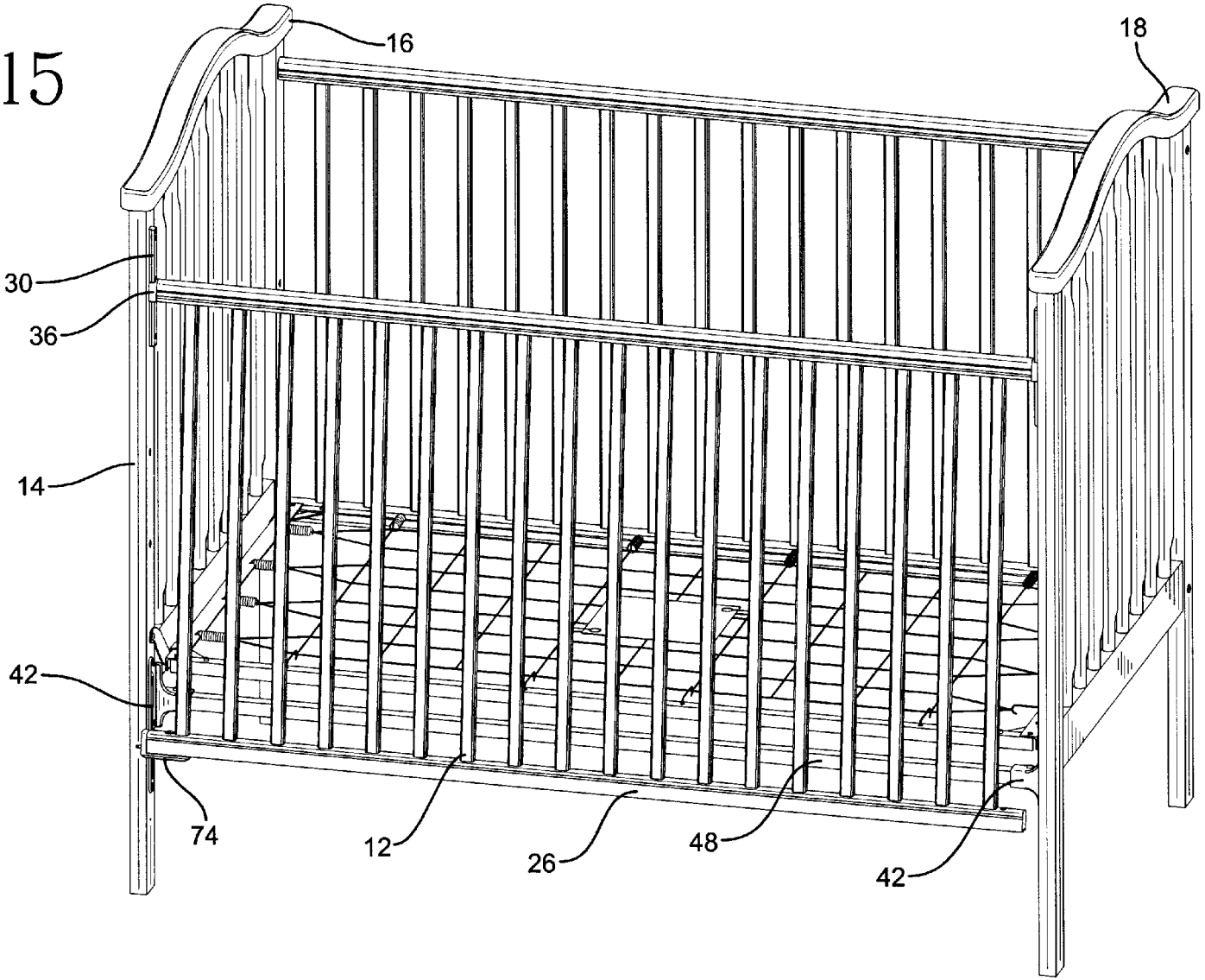
FIG. 15 is a perspective view showing the dropside partially coupled to the crib.
Figure 17:
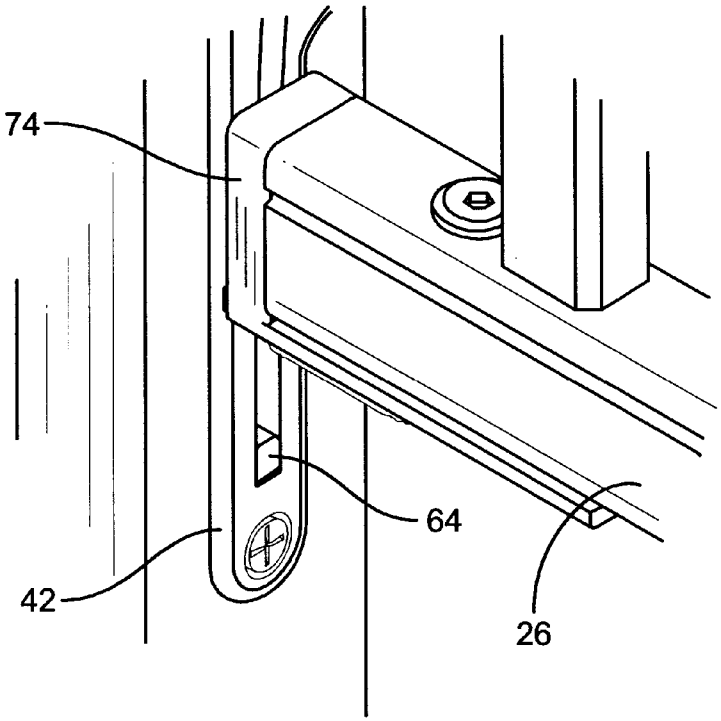
FIG. 17 is a top perspective view thereof.
Figure 16:
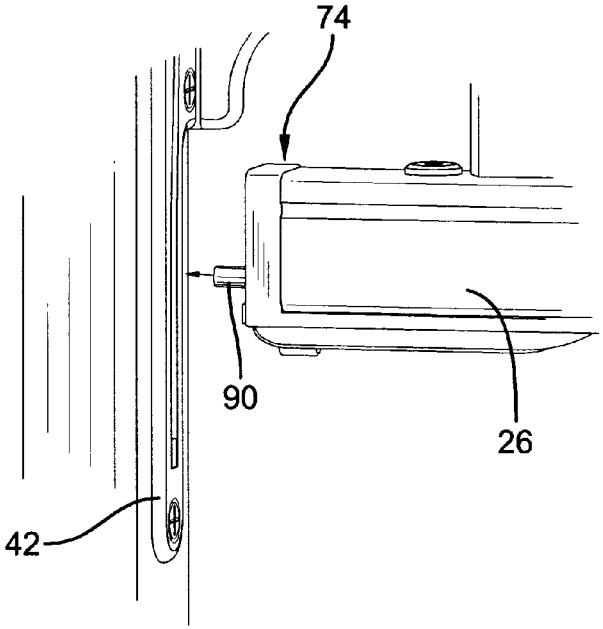
FIG. 16 is a perspective view showing the coupling of the dropside to one of the lower tracks of a crib endboard.

The upper tracks 30 are mounted to the corner posts in opposing relation by screws which extend through openings 32. The connecting members 36 are secured to the ends of the top rail 24, and one of the spring bracket assemblies 74 is secured to an end of the bottom rail 26, as shown in FIGS. 9–11. The dropside 12 is then maneuvered such that the connecting members 36 slidably engage the upper tracks 30, moving from the bottom ends of these tracks towards the top ends. The dropside extends at an angle with respect to the corner posts as this step is performed, as shown in FIG. 13. As discussed above, there is sufficient play between the connecting members 36 and upper tracks 30 to allow ease of assembly while providing reliable coupling. Once the connecting members 36 are about half way up the upper tracks 30, the pin 90 is positioned within the second groove 56 of one of the lower tracks 42, as shown in FIGS. 16–17. If necessary, pressure may be applied to the comer post in order to provide sufficient clearance for the pin. Once the pin is inserted, the dropside may be moved to the lowered position such that the pin rests on the resilient stop member 64 at the bottom end of the second groove.

Figure 22:
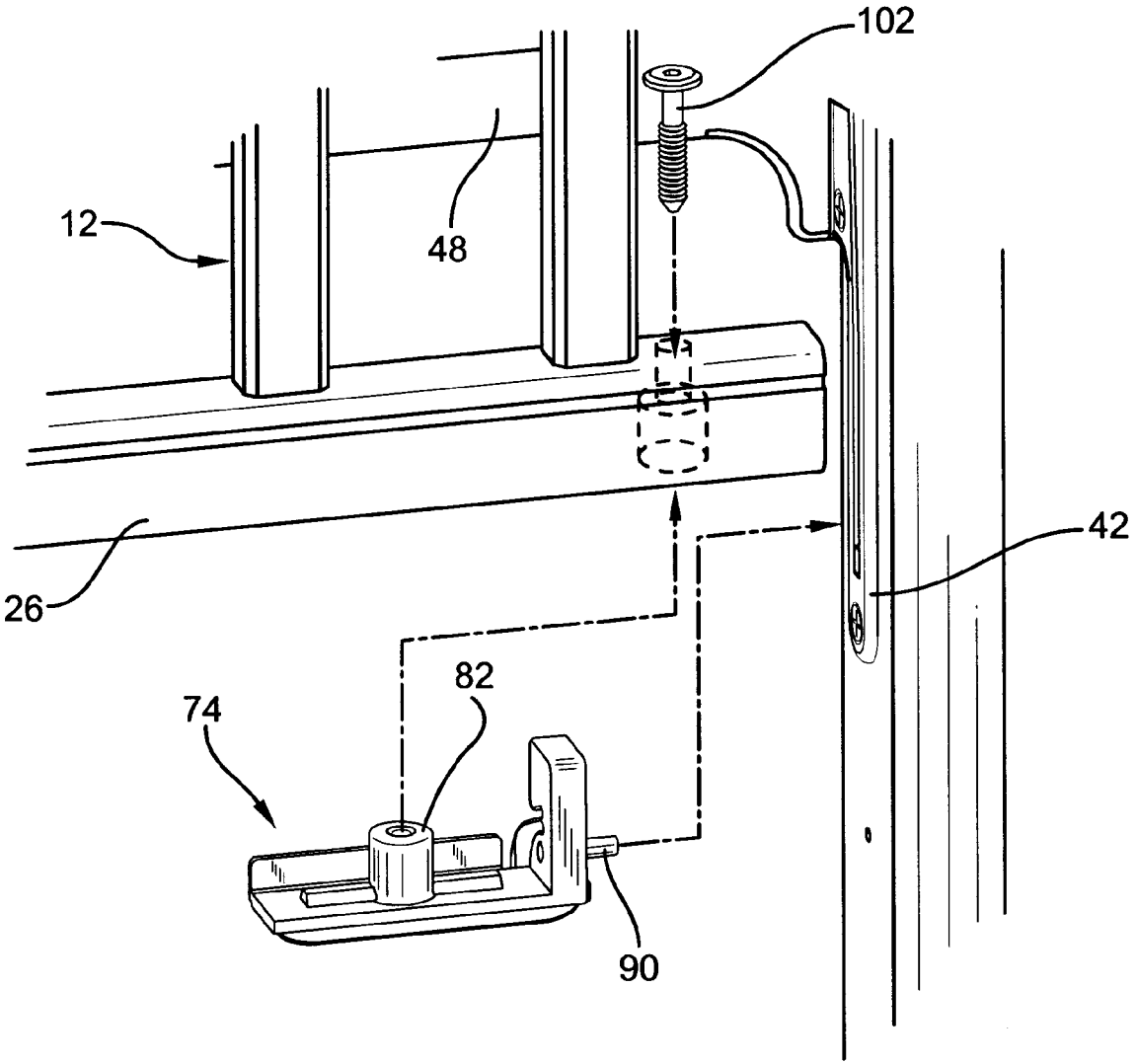
FIG. 22 is a perspective view showing the step of coupling the dropside to the second of the lower tracks.

The remaining spring bracket assembly 74 is coupled to the dropside after first inserting the pin 90 thereof into the groove 56 of the second lower track 42. Referring to FIG. 22, the dropside is raised slightly to permit such insertion, then lowered such that the cylindrical projection 82 extends within a corresponding bore 100 in the bottom rail 26. The spring bracket assembly 74 is then secured to the dropside by a threaded bolt 102 which extends through the bottom rail 26 and is threadably coupled with the steel insert 88. The mounting of the remaining spring bracket to the dropside is easily accomplished while the dropside rests in the lowered position. The tolerance of the gap between the end of the bottom rail 26 and the lower track 42 is kept to a minimum, thereby ensuring that the dropside will remain slidably coupled to the crib endboards during normal use.

The operation of the dropside in accordance with the preferred embodiment of the invention is described below, starting with the dropside in the lowered position following assembly and the pins 90 resting on the stop members 64 at the bottom ends of the second grooves 56. FIG. 18 shows the position of one of the pins with respect to a lower track with the dropside in this position. The dropside 12 is raised by exerting an upward force on the top rail 24. As the dropside is raised, the pins 90 slide upwardly along the second grooves 56 while the connecting members 36 slide along the upper tracks 30. The dropside is eventually raised to a point where the curved portions 86A of the spring arms 86 engage the walls 66 of the lower tracks 42. These walls are proximate to the second grooves. Such engagement continues until the pins 90 reach the top ends of the second grooves 56. The continuously curved surface of the spring arm allows the dropside to be raised smoothly during and after its engagement with the track wall 66. It will be further noted that a segment of the second groove 56 angles towards the wall, causing an increasing deflection of the spring arm until the pin reaches the upper segment of the second groove that runs substantially parallel to the wall 66.

The pins 90 are urged upwardly and outwardly with respect to the wall 66 once they reach the upper ends of the second grooves. The spring arms provide sufficient force to move the pins 90 quickly through the connecting groove portions 58 and into the first grooves 54. The operator can then simply lower the dropside until the pins rest at the bottom ends of the first grooves, as shown in phantom in FIG. 18. When the dropside is so positioned, the rounded top surfaces of the connecting members 36 are substantially flush with the rounded upper ends of the upper tracks 30.

The dropside is designed to avoid inadvertent displacement from the raised to the lowered position. In order to lower the dropside, it must first be raised with sufficient force that the resistance provided by the transition portions 60 of the first grooves is overcome by the pins. The dropside is then urged inwardly against the force of the spring arms 86, causing the pins 90 to travel through the connecting groove portions 58 and into the top ends of the second grooves 56. Once so positioned, the dropside is lowered until the pins are again engaging the resilient stop members 64.

It will be appreciated by those of skill in the art that the above-described components can be adapted for cribs of various sizes and configurations. The particular materials specified for use in constructing certain components are not believed to be essential, and alternatives may be satisfactory. The assembly for providing dropside height adjustment is believed to be usable with upper track and connector assemblies of various types in addition to the preferred assemblies described herein. In view of the above, the scope of the inventions should not be limited to the particular embodiments disclosed herein, but rather in accordance with the appended claims.

What is claimed is:

1. A height adjustment assembly for a crib dropside, comprising:

first and second tracks, each of said tracks including a first groove having a bottom end, a second groove having a bottom end, each of said first and second grooves having a substantially vertical portion, said bottom end of said second groove being substantially below said bottom end of said first groove, and a connecting portion connecting said first and second grooves; and first and second spring bracket assemblies, each including a body portion, a pin extending longitudinally from said body portion and positionable in said grooves within said first and second tracks, and a spring arm pivotally mounted to and extending laterally from said body portion, said spring arm including a substantially continuously curved upper surface.

2. An assembly as described in claim 1, wherein the widths of said first and second grooves are larger than the diameters of said pins, each of said first grooves including a transition portion between said bottom end and said connecting portion which is substantially the same in width as the diameters of said pins.

3. An assembly as described in claim 2, wherein said first and second grooves and said connecting portion of each of said first and second tracks form an inverted, generally J-shaped passage, said connecting portion of each J-shaped passage having an upper surface inclined upwardly from an upper end of said second groove to an upper end of said first groove.

4. An assembly as described in claim 3, wherein said body portion and spring arm of each spring bracket assembly are integrally formed of a plastic material.

5. An assembly as described in claim 4, wherein said body portion includes an end block molded about said pin, a wall integral with and extending upwardly from said end block, said arm being secured to said wall.

6. An assembly as described in claim 1, wherein each of said first and second tracks includes an L-shaped slot for receiving an end of a stabilizing bar.

7. An assembly as described in claim 1, wherein each of said first and second tracks includes an elongate base, said first and second grooves being formed in said base, and a wall integral with said base and extending perpendicularly therefrom, said first and second grooves having upper ends running substantially parallel to said wall, said second groove being proximate to said wall.

8. A crib dropside assembly comprising:

first and second corner posts;

first and second upper tracks mounted, respectively, to said first and second corner posts;

first and second lower tracks mounted, respectively, to said first and second corner posts and positioned beneath said first and second upper tracks;

a dropside slidably coupled to said first and second lower tracks and said first and second upper tracks;

first and second spring bracket assemblies mounted to said dropside, said first spring bracket assembly including a first pin and said second spring bracket assembly including a second pin, each of said spring bracket assemblies including a pivotally mounted, laterally extending spring arm, and an abutment mounted to each of said first and second corner posts, each spring arm being engageable with one of said abutments;

each of said first and second lower tracks including a first groove having a bottom end, a second groove having a bottom end, each of said first and second grooves having substantially vertical portions, said bottom end of said second groove being substantially below said bottom end of said first groove, and a connecting portion connecting said first and second grooves, each of said first grooves including a transition portion of reduced width between its bottom end and said connecting portion, each of said first and second pins extending within one of said first and second grooves, said pins each having a diameter which approximates the width of said transition portion.

9. A crib dropside assembly as described in claim 8, wherein each spring arm includes a substantially continuously curved upper surface engageable with one of said abutments.

10. A crib dropside assembly as described in claim 9, wherein each of said abutments is comprised of a wall integral with one of said first and second lower tracks, said wall being proximate said second groove.

11. A crib dropside assembly as described in claim 10, wherein each said abutments includes means for mounting an end of a stabilizer bar.

12. A crib dropside assembly as described in claim 8, wherein said first and second grooves and said connecting portion of each of said first and second lower tracks form an inverted, generally J-shaped passage, said connecting portion of each J-shaped passage having an upper surface inclined upwardly from an upper end of said second groove to an upper end of said first groove.

13. A method of assembling a dropside to a crib including first and second corner posts, first and second upper tracks and first and second lower tracks mounted, respectively, to said corner posts, each of said first and second lower tracks including grooves therein for receiving a pin, each of said grooves including a lower end and an upper end, comprising:

providing a dropside including a top rail, a bottom rail, and first and second connecting members mounted to opposite ends of said top rail;

providing first and second bracket assemblies, each bracket assembly including a body portion and a pin extending longitudinally from said body portion;

mounting said first bracket assembly to said bottom rail of said dropside;

coupling said first and second connecting members to said first and second upper tracks;

inserting said pin of said first bracket assembly into said groove in said first lower track;

inserting said pin of said second bracket assembly into said groove in said second lower track; and mounting said second bracket assembly to said bottom rail of said dropside while said pin of said second bracket assembly remains in said groove in said second lower track.

14. A method as described in claim 13 including the step of moving the dropside to a lowered position such that said pin of said first bracket assembly is at the lower end of one of said grooves, and mounting said second bracket assembly to said bottom said rail of said dropside while said dropside is in said lowered position.

15. A method as described in claim 13, wherein each of said first and second lower tracks includes first and second elongate grooves running generally parallel to each other, a connection groove portion connecting said first and second elongate grooves, said first groove having a first bottom end, said second groove having a second bottom end substantially below said first bottom end, said pins of said first and second bracket assemblies being inserted, respectively, in said second elongate grooves.

16. A method as described in claim 15, wherein each of said bracket assemblies includes a spring arm extending laterally from said body portion and each of said tracks includes a wall running generally parallel and proximate to said second groove, including the steps of mounting said first and second bracket assemblies to said bottom rail of said dropside such that said spring arms are engageable with said walls.

17. A crib dropside comprising:

a top rail;

a bottom rail including an end surface and a bottom surface;

a plurality of stretchers connecting said top rail and said bottom rail;

a bracket coupled to said bottom rail, said bracket including a generally L-shaped body including a first section adjoining said bottom surface of said bottom rail and a second section adjoining said end surface of said bottom rail;

a pin mounted to said second section of said bracket and extending longitudinally outwardly therefrom, and a spring arm coupled to said second section of said bracket and extending laterally therefrom, said spring arm including a continuously curved upper surface.

18. A crib dropside as described in claim 17, wherein said spring arm is coupled to said second section at a point above said pin.

19. A crib dropside as described in claim 18, wherein said spring arm is integral with said second section.

20. A track for a crib dropside, comprising:

an elongate base having an upper end and a lower end;

a first, longitudinally extending groove formed in said base and including a top end, a closed bottom end, and a transition portion of reduced width between said top and bottom ends;

a second, longitudinally extending groove formed in said base and running generally parallel to said first groove, said second groove including a closed bottom end substantially below the closed bottom end of said first groove;

a connecting groove formed in said base and extending between said first groove and said second groove, said connecting groove including an upper wall angled upwardly towards the top end of said first groove, said connecting groove adjoining said first groove above said transition portion, and a plurality of openings extending through said base.

21. A track as described in claim 20 including a wall connected to said base and extending substantially perpendicularly thereto, said wall running generally parallel to said first and second grooves and proximate to said second groove.

22. A track as described in claim 21 including a bracket integral with said wall and defining an L-shaped channel.

23. A track for a crib dropside comprising:

an elongate base having an upper end and a lower end;

a first, longitudinally extending groove formed in said base and including a top end, a bottom end, and a transition portion of reduced width between said top and bottom ends;

a second, longitudinally extending groove formed in said base and running generally parallel to said first groove, said second groove including a bottom end substantially below the bottom end of said groove;

a connecting groove formed in said base and extending between said first groove and said second groove, said connecting groove including an upper wall angled upwardly towards the top end of said first groove, said connecting groove adjoining said first groove above said transition portion;

a plurality of openings extending through said base;

a wall connected to said base and extending substantially perpendicularly thereto, said wall running generally parallel to said first and second grooves and proximate to said second groove, and a bracket integral with said wall and defining an L-shaped channel.

* * * * *